US008166636B2

(12) United States Patent
Malvestiti et al.

(10) Patent No.: US 8,166,636 B2
(45) Date of Patent: May 1, 2012

(54) APPARATUS WITH A CENTERING DEVICE FOR POSITIONING AND CUTTING A LAMINATE

(75) Inventors: Alberto Malvestiti, Cinisello Balsamo (IT); Claudio Malvestiti, Cinisello Balsamo (IT); Sergio Confalonieri, Cabiate (IT)

(73) Assignee: Ernesto Malvestiti S.p.A., Cinisello Balsamo (MI) (IT)

( * ) Notice: Subject to any disclaimer, the term of this patent is extended or adjusted under 35 U.S.C. 154(b) by 278 days.

(21) Appl. No.: 12/391,403

(22) Filed: Feb. 24, 2009

(65) Prior Publication Data

US 2009/0173204 A1 Jul. 9, 2009

Related U.S. Application Data

(63) Continuation of application No. 11/748,556, filed on May 15, 2007, now abandoned.

(30) Foreign Application Priority Data

May 24, 2006 (EP) ..... 06010722

(51) Int. Cl.
*H02K 15/00* (2006.01)

(52) U.S. Cl. ..... 29/732; 29/596; 29/281.1

(58) Field of Classification Search ..... 29/729, 29/732–736, 596–598, 515; 72/345–350, 72/379, 427; 83/267, 571; 140/92.2, 441
See application file for complete search history.

(56) References Cited

U.S. PATENT DOCUMENTS

| | | | | |
|---|---|---|---|---|
| 3,599,680 | A * | 8/1971 | Burr | 140/92.2 |
| 4,597,168 | A * | 7/1986 | Oboshi et al. | 29/596 |
| 5,062,200 | A * | 11/1991 | Lanfranco | 29/732 |
| 5,272,902 | A * | 12/1993 | Kobak | 72/348 |
| 6,014,883 | A * | 1/2000 | McClung | 72/347 |
| 6,745,548 | B1 * | 6/2004 | Phillip et al. | 56/10.5 |

FOREIGN PATENT DOCUMENTS

| | | |
|---|---|---|
| EP | 0133 859 A1 | 3/1985 |
| GB | 134 371 A | 11/1919 |
| JP | 59 165943 | 9/1984 |

* cited by examiner

*Primary Examiner* — Minh Trinh
(74) *Attorney, Agent, or Firm* — Hess Patent Law Firm, PC; Robert J. Hess

(57) ABSTRACT

A mold houses a least one cutting die that defines a die axis. The mold has at least one punch aligned with the die axis and movable in a reciprocating manner that cooperates with the at least one cutting die to cut the laminate into the laminations by carrying out cutting steps. The mold has a centering device within the mold that locks the at least one cutting die into a desired position prior to each of the cutting steps. A punching movement of the at least one punch is coordinated with a feeding movement of the laminate to a location within the mold that is interposed between the at least one punch and the cutting die.

19 Claims, 3 Drawing Sheets

APPARATUS WITH A CENTERING DEVICE FOR POSITIONING AND CUTTING A LAMINATE

BACKGROUND OF THE INVENTION

1. Field of the Invention

The present invention relates to a centering device for blanking dies, particularly a centering device to be associated with the rotary die of a mold for producing laminations for electric motors.

2. Discussion of Related Art

The stators and rotors of several types of electric motors are made by packing of a plurality of suitably shaped laminations, which are made of ferromagnetic material. The individual laminations are generally obtained from metal laminates that are subjected to molding and punching processes. The thus-obtained laminations are coupled to each other; in particular, they are stacked to form the core of a rotor or to form a stator. Each lamination is provided with slots, which along with the slots of the other laminations, define the slots for housing the stator/rotor windings or for housing the melt material alternatively used (generally die-cast aluminum).

The laminations used for making rotors of electric motors can be coupled such that the rotor has straight or skew slots, such as having a helical development. In other words, the laminations can be stacked on each other without offset, such that the slots for the windings are overlapped to form a straight slot, or with an angular offset, such that the slots of a first lamination result to be rotated relative to the matching slots of a second lamination adjacent thereto, in order to form a slot for the winding which is either skew or helical.

The laminations are coupled to form a pack having the desired height, corresponding to the height of the rotor or stator of the electric motor to be made. Regardless of the slot shape, when the pack is made up of a large number of laminations, any difference in the thickness that can be found between the different portions of the laminations can lead to inaccurate assembly.

For those packs made up of a large number of laminations, for example more than 100, a "compensation" may be required during the manufacturing step. The compensation is carried out by stacking the laminations such that the pack mass is evenly distributed relative to the axis thereof. For example, the rotors or stators are "compensated" by packing each lamination such as to be offset by a preset angle, such as 900 relative to the adjoining lamination (and this can be provided for all the laminations in the pack or laminations sets) such that any non-uniformity of an individual lamination is evenly distributed relative to the axis of rotation of the lamination pack. The compensation of the lamination pack can be required both when manufacturing stator packs and when manufacturing rotor packs.

Generally, the lamination coupling is carried out by providing each lamination with one or more bosses. Usually, the laminations are stacked during the manufacturing step, directly within the mold and during the punching step, by forcing the bosses of a lamination in the matching bosses of the adjoining lamination in the same stack.

The molds are provided with a die, which by cooperating with a punch, provides to cut the metal laminate being fed to the mold, thereby separating the laminations. The punch is fastened to a mold portion, which moves in a vertical and reciprocating manner on the laminate, which remains interposed between the punch and the die. The laminate feeding movement is coordinated with the punch movement, such that—upon each downward movement of the punch—new portions of the laminate are intercepted by the punch and die to be cut.

When the "compensation" is required for the lamination pack, the mold is equipped with a die to be rotated about its own axis. The rotary die provides to make the individual laminations (by cutting the laminate in cooperation with the punch) such as to be offset relative to the previously worked lamination, such as to compensate any non-uniformity in the mass distribution of the lamination pack to be made.

The operation of the mold provides that the punch and die carry out the cutting of a first lamination. In a later time, after the punch has been raised from the laminate and the latter has been fed forward, the die rotates about its own axis according to a preset angle. The punch is forced once again on the laminate to carry out the cutting of a second lamination. The second lamination is angularly offset relative to the previously-cut lamination. The offset angle corresponds to the angle of rotation of the die.

The die is fixed to a support sleeve that is pivotally fastened to the lower portion of the mold. The sleeve is fitted within a seat of the mold and is, in turn, supported by bearings. A suitable motor rotates the sleeve, and thus also the die, according to the desired angle.

Traditionally, the portion of the mold supporting the die is the stationary, lower portion, while the portion of the mold supporting the punch is the upper portion, which is vertically moved in a reciprocating manner. The upper portion of the mold is suitably guided during the vertical movement thereof, such that the punch and die are always properly aligned with each other.

The guide device of the upper portion of the mold comprises at least one pilot "column", which is generally a rigid rod fastened to the upper portion of the mold that slidably engages the support sleeve of the punch die and engages a centering bush, which is also fastened to the sleeve. When the punch is moved down to the laminate to carry out the cutting, the pilot column also vertically moves, thereby bringing a distal end thereof in engagement with the centering bush, opposite the punch. Thereby, the guide device holds the punch and die centered during the cutting step.

Current molds can provide high operating speeds. For example, the punch and pilot column can be operated 300 times/minute. The accuracy of the guide device in centering the two portions of the mold (upper and lower) and thus in centering the punch relative to the die, is important to ensure high quality and output standards.

Disadvantageously, the traditional guide devices do not allow a fine alignment to be achieved for the die relative to the desired position, and consequently relative to the punch, when the die is rotated. The slidable coupling between the pilot column and the centering bush provides that a clearance, though minimal, is left between these elements. In other words, the section area of the distal end of the pilot column must be lower than the section area of the seat of the centering bush in which it is fitted. Thereby, any damaging interference is avoided between the pilot column and the bush, which may cause jamming.

The clearance that must be provided between the pilot column and the centering bush is a restraint for the proper and repetitive positioning of the die during the laminate processing, which means that the maximum precision that can be obtained by means of the centering device is equal to the clearance between the column and bush. In the current practice, undesired misalignments between the packed laminations are mostly caused by the non-repetitiveness of the die positionings. In other words, the die rotates prior to a new cutting action, but due to the clearance provided for the elements of the guide device, the re-positionings are not identical over time, with clear negative consequences on the process accuracy.

A further drawback with the traditional molds is that the motor that rotates the sleeve within the seat thereof is generally subjected to a systematic, though minimum, error, which determines slight inaccuracies when the sleeve is angularly positioned. Consequently, the die can result improperly aligned relative to the punch. After a number of cutting cycles, these inaccuracies are likely to result in localized wear of the centering bush, i.e. several points on the centering bush are worn before others.

Disadvantageously, in the traditional molds, the centering bush is subjected to abrasion caused by the metal dust obtained from the cutting of the laminations, which dust deposits on the bush and on the distal end of the pilot column engaging the same.

Among mold manufacturers, the need has been felt for some time to maximize the accuracy of positioning of the rotary cutting die.

One aspect of the present invention is to provide a centering device for rotary cutting dies which solves the drawbacks of traditional devices in a simple and effective manner, thus allowing a high repeatability of the positionings of the relative die to be obtained.

A further aspect of the present invention to provide a centering device for rotary cutting dies, which allows minimizing, during the manufacturing step, the inaccuracies in the alignment of the laminations in a same pack.

Another aspect of the present invention to provide a centering device for rotary cutting dies which provides recovering and canceling the clearances relative to the positioning of the relative die.

SUMMARY OF THE INVENTION

These and other aspects are realized with the present invention, which relates to a centering device for a cutting die within a mold, the die being supported by a sleeve to be rotated about the die axis, characterized in that it comprises at least two cavities formed on the side surface of said sleeve and spaced along a same circumference, and at least one wedge-like element fastened to said mold and to be alternatively engaged in one of said at least two cavities of the sleeve with a conical coupling, in order to lock the sleeve following a rotation of the same.

The centering device according to the present invention provides that the wedge-like element engages the side of the support sleeve of the die, thus temporarily locking the same in the desired position following a rotation of the same and prior to the cutting step.

The operation of the device is simple. When the compensation of the lamination pack is carried out, between two subsequent cutting steps, the sleeve is rotated to bring the die in the desired angular position, i.e. the position corresponding to the angular offset between the laminations that are cut and stacked. When the sleeve is rotated, the wedge-like element of the centering device is fitted within one of the cavities formed in the sidewall of the sleeve. The conical coupling between the wedge-like element and the sleeve is clearance-free. Thereby, the accuracy of the positioning of the sleeve, and thus also the accuracy of the positioning of the centering die fixed thereto, is maximized. When the centering device holds the die locked, the punch carries out the cutting of a lamination. The centering device disengages the sleeve such that the die is allowed to rotate for a new cutting step.

Typically, the progressive molding and the cutting of the laminations provide that the punch hits the laminate up to 300-400 times/minute. The wedge-like element of the centering device engages the support sleeve of the die with the same frequency.

The cavities formed in the support sleeve of the cutting die have a shape matching the conical shape of the wedge-like element portion.

Preferably, the support sleeve of the die is provided with a plurality of cavities for engagement with the conical element. The cavities are spaced apart on the same circumference and define preset angles (in the center). In other words, the cavities are arranged such as to allow the fine positioning of the cutting die in different angular positions.

The axis of the sleeve and die is vertical, parallel to the punch axis. The wedge-like element moves in an horizontal manner to intercept the cavities arranged on the sleeve.

The wedge-like element is fastened to the stationary portion of the mold, the same portion supporting the sleeve with the cutting die. For example, the wedge-like element is housed within a seat formed in the mold, laterally to the seat of the sleeve.

The wedge-like element is driven by a cam, which is fastened to the movable portion of the mold, i.e., the portion supporting the punch. The cam moves in a vertical and reciprocating manner with the punch. When the punch is forced downwards, the cam drives the centering device for locking the die following a rotation of the same.

The cam engages the wedge-like element by means of a conical coupling, preferably by means of an inclined surface sliding on a corresponding inclined surface of the wedge-like element. The coupling is such that the cam, by moving in a vertical manner, forces the wedge-like element horizontally towards the sleeve. Preferably, the cam is provided with a distal end, which is brought into engagement with a bush fastened to the stationary portion of the mold. The cam applies a force on the wedge-like element, which is sufficient to lock the sleeve.

The device further comprises a counter-element, which has the function of taking the wedge-like element back to its initial position after the disengagement of the cam, i.e. when the upper portion of the mold, provided with the punch, is raised from the lower portion, where the die is housed.

The centering device according to the invention allows obtaining high performances, in terms of production speed, with high accuracy as to the positioning of the die. The clearance existing between the distal end of the pilot column and the bush are, in fact, "recovered", i.e. cancelled, due to the fact that a portion of the wedge-like element engages the support sleeve of the die with a conical coupling. By providing a conical coupling between the wedge-like element and the sleeve, the centering device according to the present invention thus allows maximizing the precision and repetitiveness of the positionings of the cutting die, with clear advantages for the quality of lamination processing.

Even if the rotation of the sleeve operated by the relative motor is not accurate, the centering device provides to compensate any positioning errors. When the wedge-like element engages a cavity of the sleeve, the die is locked in the desired angular position, with a greater precision as compared with the traditional molds not provided with the device.

The wedge-like element is laterally fitted within the support sleeve of the die. For example, the wedge-like element is forced within the seat of the sleeve starting from the side surface of the same seat. Relative to what has been provided for the traditional guide devices of the molds, the centering device according to the present invention is configured such that it is not affected by the abrasive action of the metal dust generated by the lamination cutting.

BRIEF DESCRIPTION OF THE DRAWING

Further aspects and the advantages of the present invention will be better understood from the description below, which is to be considered by way of a non-limiting example with reference to the annexed figures, in which:

With reference to FIGS. 1 and 2, a mold is shown for progressive cutting of laminates L. A laminate L is fed to the mold in the direction F (FIG. 1).

DETAILED DESCRIPTION OF THE INVENTION

Particularly, the lower portion S of the mold is stationary, and houses at least one cutting die M that is arranged with a vertical axis Y. The upper portion S' is provided with at least one punch P, also aligned on the axis Y, and is vertically movable in a reciprocating manner, such as to bring the punch P to cut the laminate L at the die M.

Figure 2:
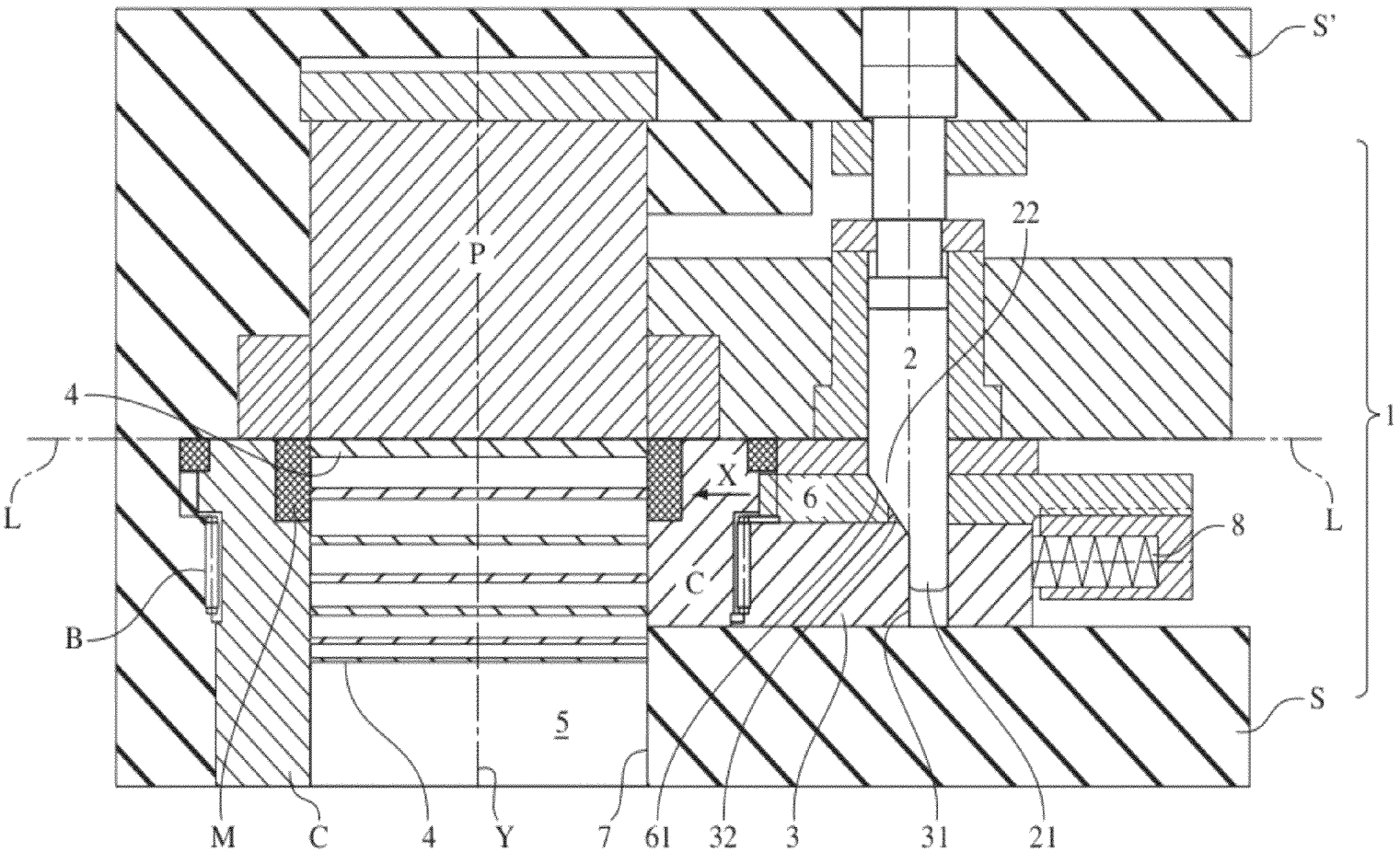
FIG. 2 is a sectional view of a centering device according to the present invention.

After each cutting step, the laminate L is fed for a certain tract in the direction F, which is for a new cutting step. In FIG. 2, the cutting laminations 4 are schematically shown as being temporarily housed in the free space 5 within the die M. The laminations 4 can be stacked for making rotors of electric motors, or for making stators.

The die M is fixed to a sleeve C housed within a suitable seat 7 being formed in the portion S of the mold. The sleeve C is pivotable in the seat 7, supported by bearings B. The rotation of the sleeve C is controlled by a motor (not shown) and allows rotating the die M in order to carry out the compensation of the lamination pack 4.

When the compensation of the lamination pack 4 is required, the sleeve C rotates by a preset angle to bring the die M in the desired angular position, prior to each cutting step.

The mold is provided with a centering device 1 according to the present invention, which has the function of locking the die M in the desired position prior to each cutting step.

Figure 3:
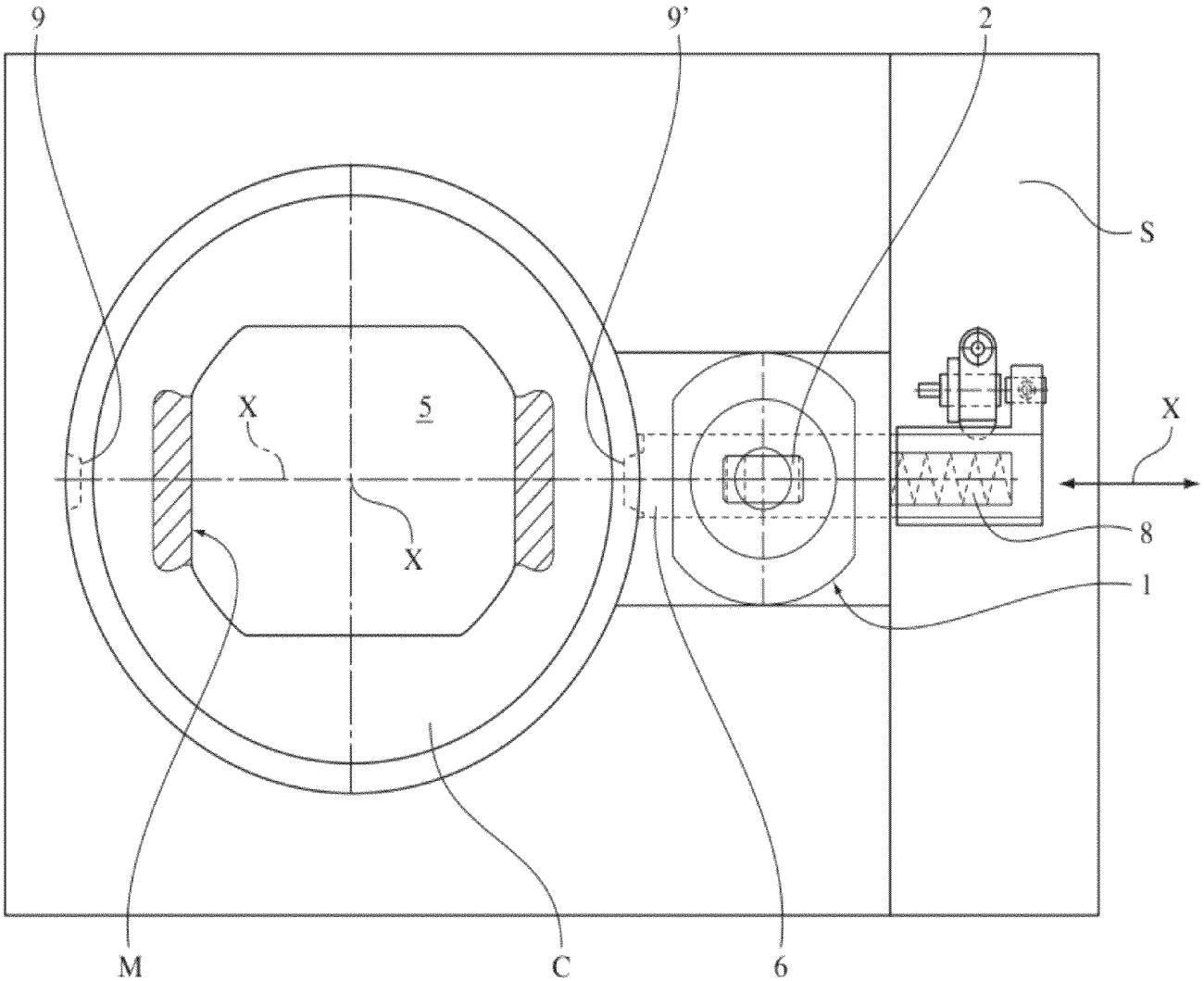
FIG. 3 is a plane, top view of the centering device shown in FIG. 2.

With reference to FIGS. 2 and 3, the device 1 comprises a wedge-like element 6, which is suitable to engage the sleeve C, in order to temporarily lock the latter during the cutting step. The coupling between the sleeve C and the wedge-like element 6 is of a conical type, without clearance.

The sleeve C is provided with at least two cavities 9 and 9' that are formed in the sidewall thereof. The cavities 9 and 9' have the function of housing at least one conical portion of the wedge-like element 6. In the embodiment shown herein, the cavities 9 and 9' are diametrically opposite relative to the center O of the sleeve C and die M. Generally, the sleeve C can be provided with a plurality of cavities 9, 9' being arranged along the periphery thereof (on the same circumference) such as to intercept different angles in the center, which correspond to the desired angular positions for the die M.

The wedge-like element 6 of the device 1 is movable in the direction X, i.e. horizontally and transversally to the axis Y, to be fitted within the seat 7 and intercept a cavity 9 or 9' of the sleeve C. A motor provides to rotate the sleeve C in order to bring a cavity 9 or 9' into alignment with the conical element, along the direction X. The wedge-like element 6 is slidably fastened to the mold, in a suitable seat of the portion S, and is driven by a cam 2, which is fastened to the upper portion S'.

The cam 2 is movable parallel to the axis Y, with the portion S' of the mold. The cam 2 is provided with a shaped portion with an inclined surface 22 having the function of being abutted against a matching inclined portion 61 of the wedge-like element 6. When the upper portion S' of the mold is lowered to the lower portion S to carry out the cutting of the laminate L, the portion 22 of the cam 2 slides on the inclined surface 61 of the wedge-like element 6, thereby causing the movement of the same towards the sleeve C. In other words, the coupling between the cam 2 and the wedge-like element is such that the reciprocating movement of the cam 2 in the vertical direction determines the reciprocating movement of the wedge-like element 6 in the horizontal direction X.

The device 1 further comprises a counter-element 8, such as a spring, having the function of taking the wedge-like element 6 back to its initial position of disengagement relative to the cavity 9 or 9', when the cam 2 is raised together with the portion S' of the mold.

As shown in FIG. 2, the cam 2 is provided with a distal end 21 which engages the seat 31 of a bush 3, which is fixed to the portion S of the mold. When the cam 2 is lowered together with the movable portion S' of the mold, the distal portion 21 of the same is fitted within the bush 3 and is guided in its movement by the latter.

The centering device 1 allows optimizing the performance of the mold, thus favoring a high repeatability of the positionings of the sleeve C, and thus of die M, at each cutting cycle. The conical coupling between the wedge-like element 6 and the sleeve C is free of mechanical clearance, and is also effective when the parts in contact are worn. Any positioning errors due to the inaccuracy of the motor rotating the sleeve C are prevented. The die M is always properly positioned within the mold S, both relative to the punch and relative to the laminate L. Thereby, the die M is worn in a uniform manner.

Figure 1:
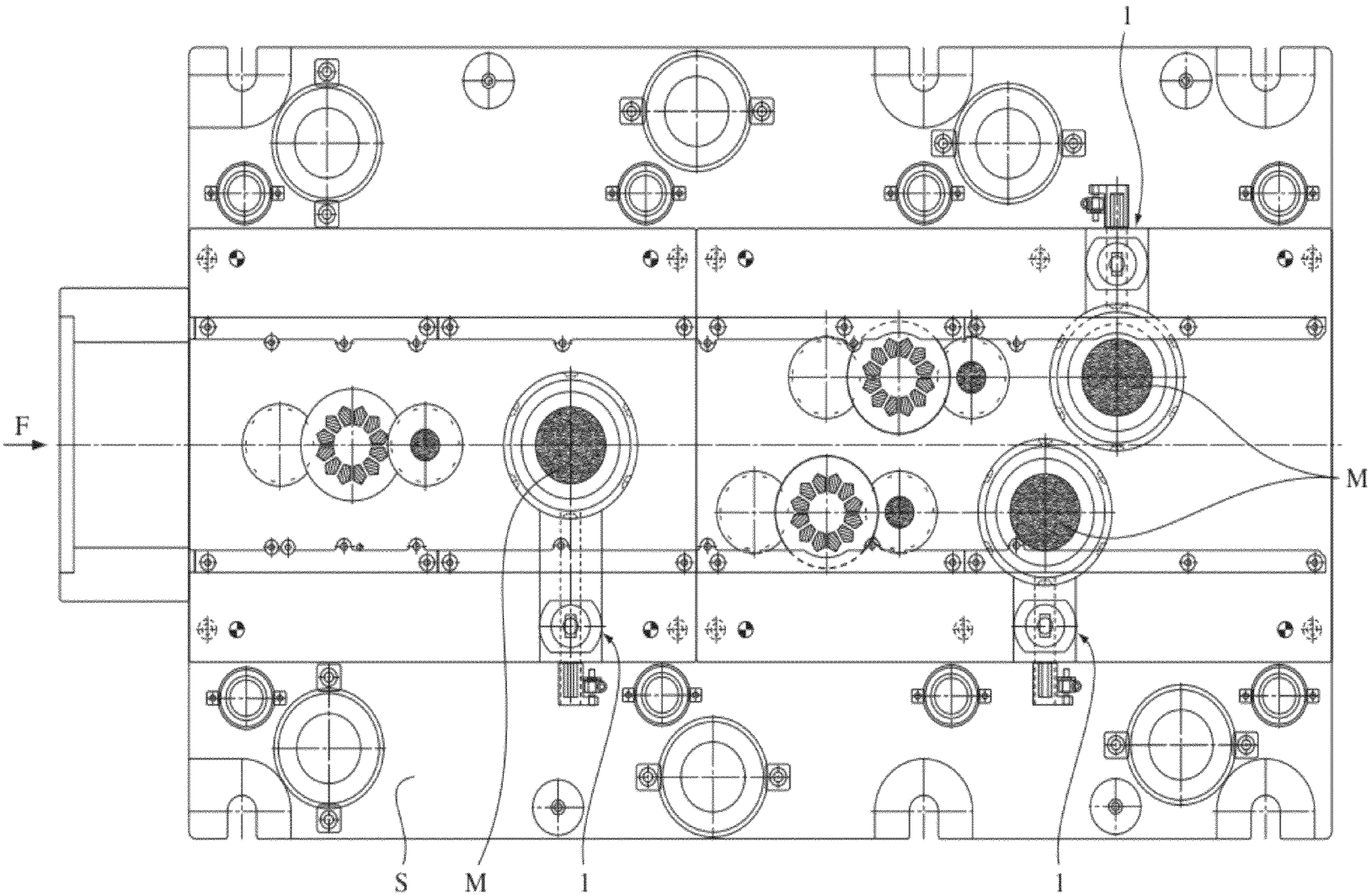
FIG. 1 is a plane view of a portion of a mold provided with a centering device according to the present invention.

A further advantage of the device 1 is due to the fact that, as shown in FIG. 1-3, the device is external to the sleeve C, i.e. it is not provided with parts mounted on the rotary sleeve C, which can thus have a minimum size. Thereby, the rotational masses are minimized, with clear dynamic advantages.

Advantageously, the mold provided with the device 1 may not be provided with pilot columns, which engage a bush fastened to the sleeve C, unlike what is provided in the traditional embodiments. In other words, the device 1 allows the mold structure to be simplified.

What is claimed is:

1. An apparatus suited for manufacturing laminations (4), comprising manufacturing means for forming laminations from a laminate, said manufacturing means including a mold that houses a least one cutting die that defines a die axis, the mold having at least one punch aligned with the die axis and movable in a reciprocating manner that cooperates with the at least one cutting die to cut the laminate into the laminations by carrying out cutting steps, the mold having a centering device within the mold that locks the at least one cutting die into a desired position prior to each of the cutting steps, the manufacturing means coordinating a punching movement of the at least one punch with a feeding movement of the laminate to a location within the mold that is interposed between the at least one punch and the cutting die, the cutting die being supported by a sleeve that is rotatable about the die axis, said sleeve having two or more cavities formed on a side surface of said sleeve and spaced along a same circumference of said sleeve, and locking means for locking the sleeve following a rotation of the sleeve about the die axis, said locking means including at least one wedge element fastened to said mold and arranged to be alternatively engaged in one of said two or more cavities of the sleeve with a conical coupling.

2. The apparatus according to claim 1, wherein said two or more side cavities are angularly spaced apart according to preset angles, in order to allow the sleeve to be locked in a corresponding plurality of angles of rotation.

3. The apparatus according to claim 1, in which said at least one wedge element is transversally movable relative to said sleeve.

4. The apparatus according to claim 3, further comprising a cam that is movable with the punch, said at least one wedge element being arranged to be driven by the cam.

5. The apparatus according to claim 1, in which said at least one wedge element is driven by a cam movable with said punch.

6. The apparatus according to claim 5, wherein said cam moves in the vertical direction in an alternate motion, parallel to the die axis of said die, and said at least one wedge element moves in the horizontal direction.

7. The apparatus according to claim 5, said cam engages said at least one wedge element with a further conical coupling between an inclined surface of the cam sliding on a corresponding inclined surface of the wedge element.

8. The apparatus according to claim 5, wherein said cam is provided with a distal end, which engages a bush fixed to a stationary portion of the mold.

9. The apparatus according to claim 5, further comprising a counter-element suitable to take said at least one wedge element back to its initial position after said cam has been disengaged.

10. The apparatus according to claim 5, wherein said cam (2) engages said at least one wedge element with a further conical coupling between an inclined surface of the cam sliding on a corresponding inclined surface of the at least one wedge element.

11. The apparatus according to claim 10 wherein the cam is movable parallel to the axis, the cam having a shaped portion with an inclined surface that abuts against a matching inclined portion of the at least one wedge element.

12. The apparatus according to claim 10, wherein the further conical coupling is between the cam and the at least one wedge element is such that reciprocating movement of the cam in a vertical direction determines reciprocating movement of the wedge element in a horizontal direction.

13. The apparatus according to claim 12, wherein the cam is provided with a distal end that engages a seat of a bush, which is fixed to a portion of the mold, the distal portion of the cam being fitted within the bush and is guided in movement by the bush.

14. The apparatus according to claim 12, wherein the mold is free of any pilot columns that would otherwise engage the bush.

15. The apparatus according to claim 5, wherein said cam is provided with a distal end, which engages a bush fixed to a stationary portion of the mold.

16. The apparatus according to claim 1, wherein said at least one wedge element temporarily locks said sleeve during a cut of the laminate.

17. The apparatus according to claim 1, wherein the at least one wedge element has at least one conical portion housed by the cavities.

18. The apparatus according to claim 1, wherein the at least one wedge element is movable horizontally and transversely relative to the axis to be fitted within a seat and to intercept one of the cavities, the at least one wedge element being slidably fastened to the mold.

19. The apparatus according to claim 1, the conical coupling between the at least one wedge element and the sleeve is free of mechanical clearance.

* * * * *